US005126210A

United States Patent [19]

Wieserman et al.

[11] Patent Number: 5,126,210

[45] Date of Patent: Jun. 30, 1992

[54] ANODIC PHOSPHONIC/PHOSPHINIC ACID DUPLEX COATING ON VALVE METAL SURFACE

[75] Inventors: Larry F. Wieserman; Karl Wefers, both of Apollo; Gary A. Nitowski, Natrona; Edward S. Martin, New Kensington, all of Pa.

[73] Assignee: Aluminum Company of America, Pittsburgh, Pa.

[21] Appl. No.: 634,900

[22] Filed: Dec. 27, 1990

Related U.S. Application Data

[62] Division of Ser. No. 397,281, Aug. 23, 1989, Pat. No. 5,032,237.

[51] Int. Cl.[5] ..... B32B 15/00

[52] U.S. Cl. ..... 428/469; 428/457; 428/472.2; 428/472.3; 430/278; 502/401; 502/407

[58] Field of Search ..... 428/457, 469, 472.2, 428/472.3; 430/278; 204/33, 38; 502/401, 407

[56] References Cited

U.S. PATENT DOCUMENTS

| | | | |
|---|---|---|---|
| 3,013,904 | 12/1961 | Cupery | 117/76 |
| 3,799,848 | 3/1974 | Kolic et al. | 204/38 |
| 4,308,079 | 12/1981 | Venables et al. | 148/6.15 R |
| 4,308,079 | 12/1981 | Venables et al. | 148/6.15 |
| 4,383,897 | 5/1983 | Gillich et al. | 204/33 |
| 4,388,156 | 6/1983 | Gillich et al. | 204/14 |
| 4,399,021 | 8/1983 | Gillich et al. | 204/38 |
| 4,448,647 | 5/1984 | Gillich et al. | 204/33 |
| 4,788,176 | 11/1988 | Wieserman et al. | 502/401 |
| 4,957,890 | 9/1990 | Wieserman et al. | 502/4 |
| 4,994,429 | 2/1991 | Wieserman et al. | 502/401 |

FOREIGN PATENT DOCUMENTS

| | | |
|---|---|---|
| 3305354 | 8/1984 | Fed. Rep. of Germany . |
| 83006639 | 2/1983 | Japan . |

OTHER PUBLICATIONS

Application Ser. No. 07/624,793, Weiserman et al.

*Primary Examiner*—Merrell C. Cashion, Jr.
*Assistant Examiner*—Hoa T. Le
*Attorney, Agent, or Firm*—Andrew Alexander

[57] ABSTRACT

A process is disclosed for treating the surface of a valve metal such as aluminum to form a two layer protective coating thereon using an anodizing bath consisting essentially of an aqueous solution having a concentration ranging from about 0.001 molar to a saturated solution of a monomeric phosphorus- containing compound selected from the class consisting of a 1-30 carbon water soluble phosphonic acid, a 1-30 carbon water soluble phosphinic acid, and mixtures thereof. The valve metal surface is anodized in the anodizing bath while maintaining a voltage selected from a range of from about 1 to about 400 volts until the current density falls to a level indicative of the fact that a nonporous valve oxide layer has been formed on the valve metal surface and a reaction product from the monomeric phosphonic/phosphinic acid compound is chemically bonded to the oxide layer.

79 Claims, 2 Drawing Sheets

IR ABSORBANCE VALUES OF FILMS FORMED AT VARIOUS VOLTAGES IN 0.1 M PERFLUORO PHOSPHONIC ACID

ANODIC PHOSPHONIC/PHOSPHINIC ACID DUPLEX COATING ON VALVE METAL SURFACE

This application is a division of application Ser. No. 07/397,281, filed Aug. 23, 1989, now U.S. Pat. No. 5,032,237.

BACKGROUND OF THE INVENTION

1. Field of the Invention

This invention relates to a process for anodically forming a duplex coating on the surface of a valve metal such as aluminum and products resulting therefrom. More particularly, this invention relates to an anodically formed protective coating on a valve metal surface which comprises a duplex layer of metal oxide directly bonded to the valve metal surface and a functionalized layer of the reaction product of phosphonic and/or phosphinic (herein phosphonic/phosphinic) acid chemically bonded to the metal oxide.

2. Description of the Related Art

It is well known to anodize valve metals such as aluminum in electrolytes containing acids such as sulfuric, chromic, oxalic and phosphoric acid to achieve a porous metal oxide, i.e., a porous aluminum oxide, which will protect the metal, provide a decorative appearance or facilitate subsequent adhesive bonding to the metal surface.

U.S. Pat. Nos. 4,388,156, 4,381,226, 4,448,647, 4,399,021, 4,383,897, 4,308,079 and West German 3,305,354 describe processes for treating aluminum with organic and inorganic acids.

In the present invention, it has been discovered that a duplex coating can be applied to a valve metal surface in a single process. The coating comprises a layer of anodically formed valve metal oxide and a layer which is comprised of the reaction product of monomeric phosphonic or phosphinic acids.

SUMMARY OF THE INVENTION

It is, therefore, an object of this invention to provide a process for forming a chemically resistant coating on the surface of a valve metal such as aluminum which comprises a first layer of a nonporous valve metal oxide and a second layer comprised of a reaction product of monomeric phosphonic acid, monomeric phosphinic acid, or a combination of such acids.

It is another object of this invention to provide a process for forming a chemically resistant coating on the surface of a valve metal such as aluminum which comprises a first layer of a nonporous valve metal oxide and a second layer comprised of the reaction product of monomeric phosphonic acid, monomeric phosphinic acid, or a combination of such acids by anodizing the valve metal surface in an electrolyte comprising a soluble monomeric phosphonic acid, a soluble monomeric phosphinic acid, or a combination of such acids, to form a two layer coating on the valve metal surface.

It is yet another object of this invention to provide a process for forming a chemically resistant coating on the surface of a valve metal such as aluminum which comprises a first layer of a nonporous valve metal oxide on the surface of the aluminum and a second layer (which may be a monomolecular layer) of monomeric phosphonate or monomeric phosphinate, or a combination thereof, by anodizing the valve metal surface in an electrolyte comprising a water soluble monomeric phosphonic acid, a water soluble monomeric phosphinic acid, or a combination of such acids, under constant voltage conditions in the range of about 1 to about 400 volts, depending upon the desired coating thickness, until the current density falls to a level indicative of the fact that a nonporous aluminum oxide coating having a thickness of about 14 Å/v has been formed, to form the two layer coating on the aluminum surface.

It is a further object of this invention to provide a process for forming a chemically or hydration resistant coating on the surface of aluminum which comprises a first layer of a nonporous aluminum oxide and a second layer comprised of the reaction product of monomeric phosphonic acid, monomeric phosphinic acid, or a combination of such acids, by anodizing the aluminum surface in a water containing electrolyte comprising a soluble monomeric phosphonic acid, a water soluble monomeric phosphinic acid, or a combination of such acids, under constant voltage conditions of from about 1 to about 400 volts, preferably from about 30 to about 90 volts, depending upon the desired coating thickness, until the current density falls to a level indicative of the fact that a nonporous aluminum oxide coating having a thickness of about 14 Å/V has been formed, to form the two layer coating on the aluminum surface, and then washing the coating to remove excess anodizing materials leaving a monomolecular layer of phosphonate/-phosphinate chemically bonded to the aluminum oxide layer.

These and other objects of the invention will be understood from the following description and accompanying flow sheet.

DETAILED DESCRIPTION OF THE INVENTION

Figure 1:
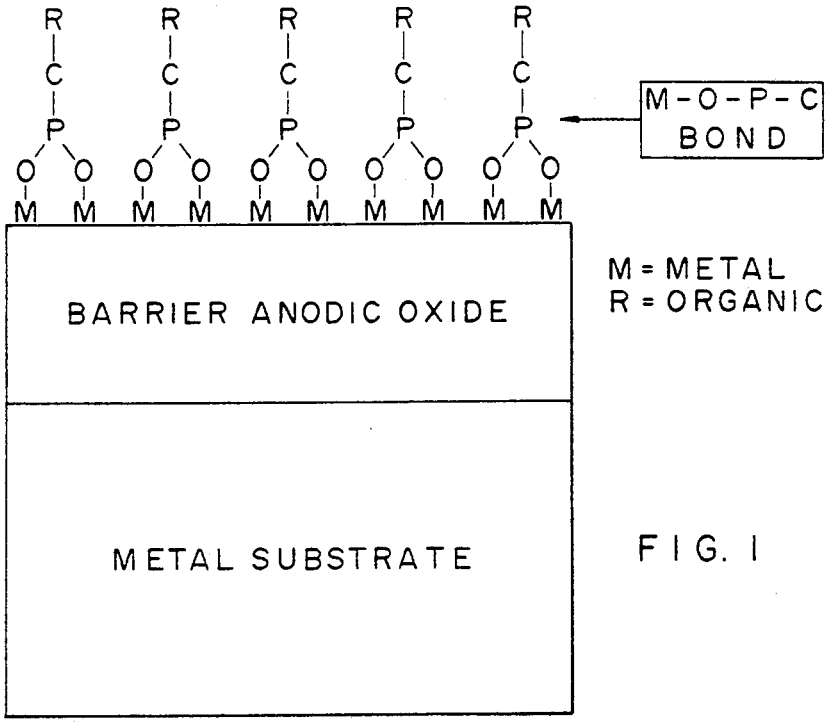
FIG. 1 illustrates the R groups in the functionalized layer extending away from the surface.

In accordance with the invention, the surface of a valve metal such as aluminum is treated to form a protective coating thereon comprising a valve metal oxide and a layer bonded thereto consisting essentially of a reaction product of a phosphorus-containing organic acid selected from the class consisting of monomeric phosphonic acid, monomeric phosphinic acid, or a combination of these acids. The coating formed by the process of the invention exhibits a preferred orientation of the reaction product, e.g., phosphonate or phosphinate, such that the phosphorus groups are attached to the valve metal oxide surface while the R groups extend away from that surface, as illustrated in FIG. 1.

Polymer as used herein means a macromolecule formed by the chemical union of five or more combining units which may be the same or different monomers, dimers, trimers, etc.

Non-porous layer as used herein means electrically insulating at a given voltage, i.e., current flow approaches zero, at 50 volts, for example. However, at 75 volts, current flows until the layer gets thicker, and again, the current flow approaches zero. In addition, the oxide has no microscopically visible pores as would be present in sulfuric acid anodized material, e.g., aluminum.

Aluminum oxide is used herein to include natural aluminum oxide as well as any anodized layer having less than 5% hydroxyl groups and preferably less than 1%.

Functionalized layer as used herein means a layer which can have a chemical reactivity ranging from non-reactive to very reactive, e.g., react with polymers, and which can be acid and basic resistant, exhibit hydrophobicity or hydrophilicity and be hydration resistant.

By hydration resistant coating is meant the functionalized layer of phosphonate/phosphinate bonded to a nonporous coating of substantially pure valve metal oxide such as aluminum oxide, e.g., with no detectable electrolyte molecules present in the nonporous aluminum oxide layer when analyzed by Auger Electron Spectrometry.

By monomeric phosphonic acid as used herein is meant a molecule having the formula:

$$R_m[PO(OH)2]_n$$

wherein R is one or more radicals having a total of 1-30 carbons; m is the number of radicals in the molecule and is in the range of 1-10; n is the number of phosphonic acid groups in the molecule and is in the range of 1-10.

By monomeric phosphinic acid as used herein is meant a molecule having the formula:

$$R_mR'_o[PO(OH)]_n$$

wherein R is one or more radicals having a total of 1-30 carbons; m is the number of R radicals in the molecule and is in the range of 1-10; R' may be hydrogen and may be comprised of 1-30 carbon-containing radicals; o is the number of R' radicals and is in the range of 1-10; n is the number of phosphinic acid groups in the molecule and is in the range of 1-10.

The valve metal surface to be treated may be in the form of foil, sheet, plate, extrusion, tube, rod or bar. The valve metal may comprise aluminum, niobium, tantalum, titanium or zirconium. The use of specific metals, e.g., aluminum, herein is meant to include alloys thereof. The valve metal may comprise a pure valve metal, which may be defined as such a valve metal with a purity of at least 99 wt. %, or a valve metal base alloy, i.e., a valve metal alloy containing at least 50 wt. % of the valve metal. When the valve metal comprises a valve metal base alloy, the alloy may comprise two or more of the above valve metals alloyed together or it may comprise one or more of the above valve metals alloyed with one or more alloying elements or impurities such as, by way of example and not of limitation, silicon, iron, copper, manganese, magnesium, molybdenum, chromium, nickel, zinc, gallium, vanadium, titanium, boron, lithium and zirconium.

The form of the aluminum surface may be planar, curved or in any other shape which will not interfere with formation of the dual layered protective coating thereon.

It will, therefore, be understood that the use of the term aluminum surface herein is intended to include all such aluminum materials and shapes.

The liquid used in the treatment of the aluminum surface preferably comprises an aqueous or water containing solution with a range of concentration of from about 0.001 molar to a saturated solution, preferably about 0.1 to about 2 molar, of one or more 1-30 carbon, preferably 1-12 carbon, soluble monomeric phosphonic acids; one or more 1-30 carbon, preferably 1-12 carbon, soluble monomeric phosphinic acids; or a mixture of the same.

Examples of groups which may comprise R and/or R' include long and short chain aliphatic hydrocarbons, aromatic hydrocarbons, carboxylic acids, aldehydes, ketones, amines, amides, thioamides, imides, lactams, anilines, pyridines, piperidines, carbohydrates, esters, lactones, ethers, alkenes, alkynes, alcohols, nitriles, oximes, organosilicones, ureas, thioureas, perfluoro organic groups, methacrylates, and combinations of these groups.

Representative of the monomeric phosphonic/phosphinic acids are as follows: amino trismethylene phosphonic acid, aminobenzylphosphonic acid, phosphomycin, 3-amino propyl phosphonic acid, 0-aminophenyl phosphonic acid, 4-methoxyphenyl phosphonic acid, aminophenylphosphonic acid, aminophosphonobutyric acid, aminopropylphosphonic acid, benzhydrylphosphonic acid, benzylphosphonic acid, butylphosphonic acid, carboxyethylphosphonic acid, diphenylphosphinic acid, dodecylphosphonic acid, ethylidenediphosphonic acid, heptadecylphosphonic acid, methylbenzylphosphonic acid, naphthylmethylphosphonic acid, octadecylphosphonic acid, octylphosphonic acid, pentylphosphonic acid, phenylphosphinic acid, phenylphosphonic acid, phosphonopropionic acid, phthalide-3-phosphonic acid, bis-(perfluoroheptyl) phosphinic acid, perfluorohexyl phosphonic acid and styrene phosphonic acid.

The phosphonic/phosphinic acid molecules such as listed above may also include inorganic groups substituted thereon such as phosphates and the like or groups such as phosphonates, sulfonates or carbonates. While it is preferred that the free end of the organic group extends away from the aluminum oxide/ hydroxide surface, it is within the scope of the present invention to provide, on the free end of the molecule, functional groups. The term functional group may be defined as the group on the molecule which enables the phosphonic/phosphinic acid molecule bonded to the aluminum oxide surface to react with, attract, repel, couple to, or bond with, etc., other atoms, ions and/or molecules. By attaching specific functional groups, either organic or inorganic, to the R and R' groups of the phosphonic and phosphinic acids, a wide variety of surface characteristics can be achieved.

Functional groups attached to the free end of the phosphonic/phosphinic acid molecule may include, but are not limited to, for example, functional groups such as —COONa, —NH , —SH, —CH=$CH_2$, —OH and —CN. Examples of other functional groups which ma be bonded to the free end of the phosphonic/phosphinic acid molecule may include, for example, a carboxyl group, a glucose group, a cyano group, a cyanate group, isocyanate group and thiocyanate group, a phenyl group, a diphenyl group, a tertiary butyl group, a sulfonic group. a benzyl sulfonic group, a phosphate group, a phosphinate group, a phosphinite group, a phosphonate group and combinations of these groups.

It should be noted that the free end of the phosphonic/phosphinic acid molecule may be further reacted after formation of the protective layer on the aluminum surface to provide the desired functionalization of the molecule discussed above if such functionalization of the phosphonic/phosphinic acid prior to treatment of the aluminum surface would interfere with such treatment or with the bond formed between the aluminum oxide layer formed during the treatment and the acid group of the phosphonic/phosphinic acid molecule. In this manner, chemical bonding of the phosphorus-containing acid group of the phosphonic/phosphinic acid molecule to the aluminum oxide surface can be assured.

To form the protective coating thereon, the aluminum surface should preferably, but not necessarily, first be cleaned to remove any excess surface oxides using, for example, a mineral acid such as nitric, hydrochloride, or sulfuric acid, or a base such as sodium hydroxide, after which the surface is rinsed with water.

After the aluminum surface has been cleaned, it may be immersed in the treatment liquid in an anodizing apparatus in which the treatment liquid is maintained at a temperature which may range from just above freezing to just below boiling, preferably from about 5° C. to about 60° C. The temperature is selected such that the solubility of aluminum phosphonate of phosphinate complexes are low.

The aluminum surface is electrically connected to the positive terminal of a voltage power supply. A counter electrode is then connected to the negative electrode of the power supply.

The cleaned aluminum surface is then anodized at a voltage in the range of 1 to 400 volts, preferably from about 30 to 90 volts, depending upon the desired aluminum oxide coating thickness which will be approximately 14Å per volt. Voltage used may be of several types, e.g., square wave, asymmetrical square wave, asymmetrical sine wave or saw tooth asymmetrical. The anodization is carried out until the current density falls to a level indicative of the fact that a nonporous aluminum oxide coating having a thickness of about 14 Å/V has been formed. Such a current density level may be defined as a level which may vary from about 0.3 milliamps/cm$^2$ for a pure aluminum (99.99%) to about 1.3 milliamps/cm$^2$ for a highly alloyed aluminum.

Normally anodizing at a pH in the range of 0.1 to 4.5 or 8 to 14 results in dissolution of barrier oxide as it is formed. However, the claimed anodizing process can be carried out at a pH as low as 0.1 without any significant dissolution of the barrier oxide by the anodizing electrolyte. This is accomplished by the presence of a functionalized layer which attaches to the surface of oxide layer on the aluminum. That is, the functionalized layer resists or prevents the electrolyte from dissolving the non-porous barrier-type oxide. Thus, the barrier-type oxide layer grows until current passage therethrough approaches zero at a given voltage.

The non-porous oxide layer on aluminum can have a density range from 2.8 to 3.2 gms/cc.

The thickness of the duplex layer can range from 100 to 5000Å and typically in the range of 200 to 1000Å.

The functionalized layer is less than 200Å thick and usually less than 100Å thick, with a typical thickness being in the range of 5 to 30Å.

The film thickness or oxide layer thickness can be as high as 25 Å/V but preferably is in the range of 12 to 16 Å/V, depending on the alloy, but typically is in the range of 13.8 to 14.2 Å/V for aluminum. Further, the oxide layer has a weight gain of less than 0.9 mg/coulomb and preferably has a weight gain in the range of 0.03 to 0.2 mg/coulomb with a typical weight gain in the range of 0.08 to 0.1 mg/coulomb.

The result is an aluminum surface having a protective coating formed thereon and bonded to the aluminum surface comprising a first layer of anodically formed nonporous dense aluminum oxide and a layer of monomeric phosphonic/phosphinic acid bonded to the aluminum oxide layer.

With respect to the bonding of the phosphonic/phosphinic acid molecule to the aluminum oxide surface, while we do not wish to be bound by any particular theory of bonding, a monolayer of phosphonic/phosphinic acid is formed uniformly on the passivation oxide at the onset of anodization. The phosphonate layer permits the field-driven diffusion of oxygen into the forming oxide barrier film, but does not allow access of the liquid to the oxide film. Thus, a nonporous barrier, dense oxide layer is formed beneath the layer of monomeric phosphonate groups.

The thickness of the resulting phosphonic/phosphinic acid monomolecular layer chemically bonded to the anodically formed aluminum oxide surface is in the range of 3-5000Å and preferably 5 to 500Å.

Examination of the layers of the subject invention by Electron Spectroscopy for Chemical Analysis (ESCA) shows a high ratio of aluminum to phosphorus. That is, aluminum can be about 6 to 30 times that of phosphorus. For example, the ratio of aluminum to phosphorus when mono vinyl phosphonic acid, allylphosphonic acid, and phenyl phosphonic acid were used as electrolytes were 24.1/3.0, 27.8/1.6, and 33.1/1.4, respectively. The phosphorus to aluminum ratio can range from 0.001 to 0.5, preferably, 0.02 to 0.2. See Table 1 below.

TABLE 1

| Atomic Concentrations Determined by ESCA (%) | | | | | |
|---|---|---|---|---|---|
| Sample | Al | O | P | C | P/AR |
| 1 M VPA(1) | 24.1 | 27.1 | 3.0 | 45.8 | 8.00 |
| 1 M APA(2) | 27.8 | 30.8 | 1.6 | 39.8 | 17.2 |
| 1 M PPA(3) | 25.6 | 43.8 | 0.9 | 26.4 | 0.035 |

(1)Mono vinyl phosphonic acid
(2)Allylphosphonic acid
(3)Phenyl phosphonic acid

This shows that the acids are not incorporated into the oxide barrier layer but are bonded on the surface of the layer thereby protecting the oxide from dissolution by the electrolyte.

Figure 2:
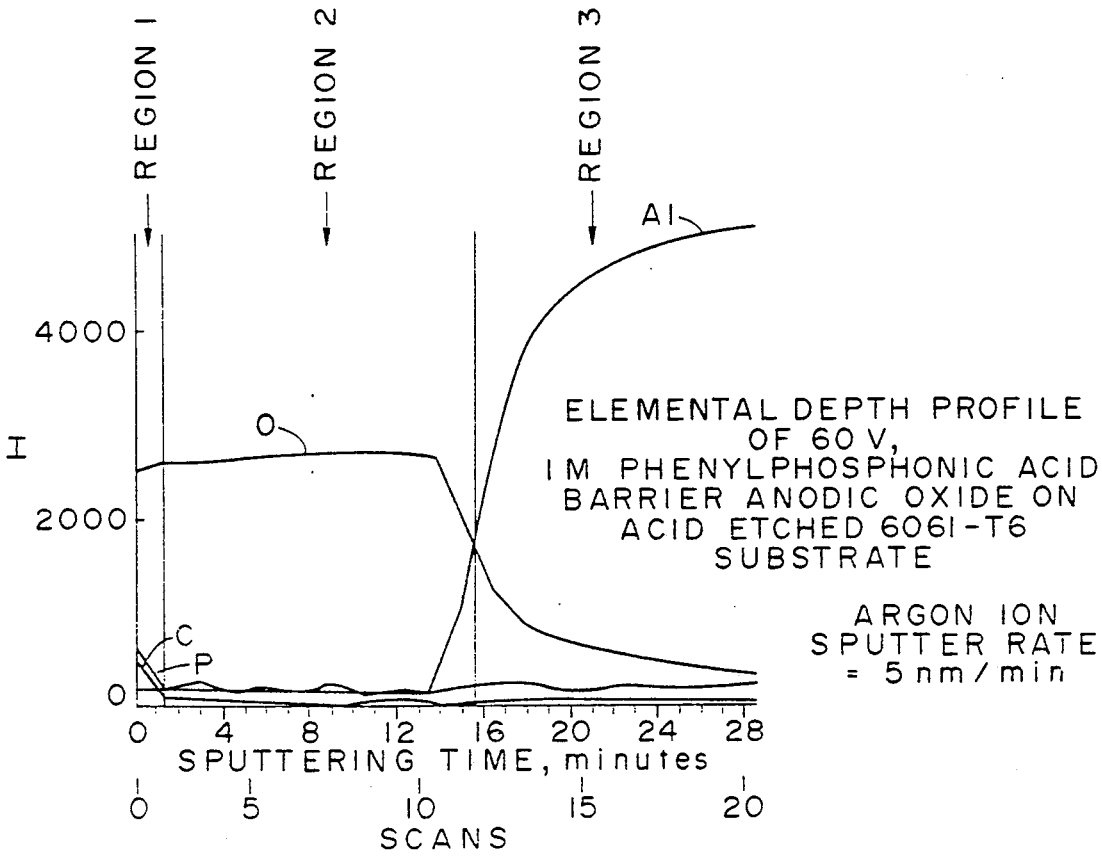
FIG. 2 is a depth profile analysis by AES confirming the duplex coating in accordance with the invention.

In addition, depth profiles of the multilayer coating of the present invention confirm that the acids or reaction products thereof are not incorporated into the oxide layer but are attached to the surface. That is, in sputtering depth profiles by Auger Electron Spectroscopy (AES) of the duplex layer or coating formed in accordance with the subject invention using phenyl phosphonic acid (FIG. 2) shows the amount of carbon and phosphorus decreasing very quickly in the first minute of sputtering (50Å/min). This shows that these elements (carbon and phosphorus) are on the surface and constitute the functionalized layer. By comparison, oxygen concentration starts and is maintained at a high level for about the first 15 minutes before starting to drop off when the aluminum signal of the base metal starts to increase, showing the anodic oxide layer has a relatively constant composition of $Al_2O_3$.

Figure 3:
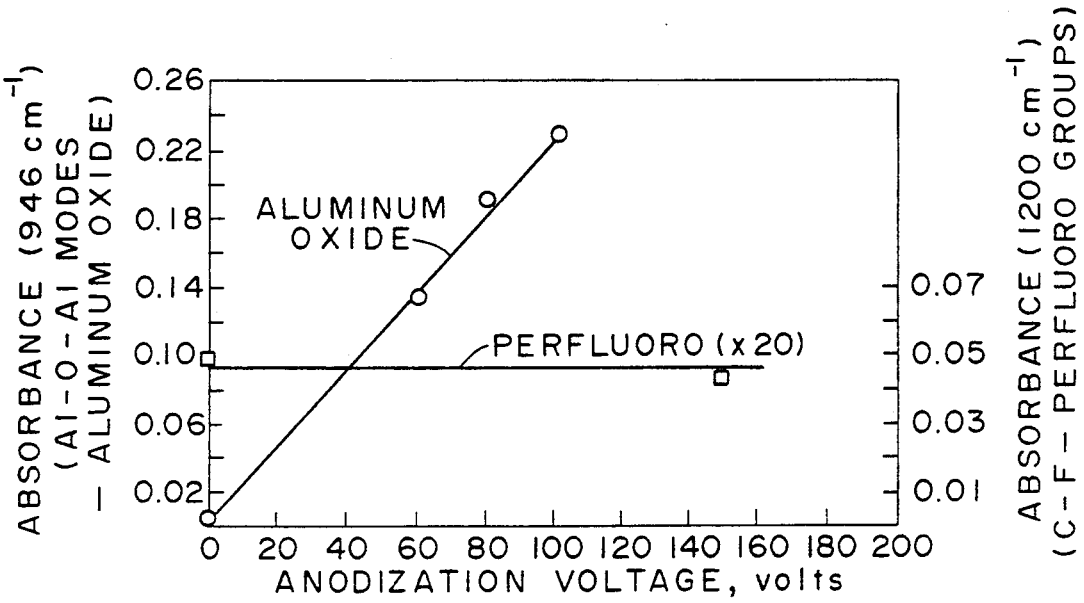
FIG. 3 is an FTIR analysis of the dual coating showing that aluminum oxide layer thickness increases with increased voltage, and the functionalized layer remains relatively constant with the increase in voltage.

Further evidence that the functionalized layer is present on the surface of the oxide layer and not incorporated into the oxide layer is shown in FIG. 3 which shows an increase in aluminum oxide thickness proportional to the anodizing voltage. For FIG. 3, an aluminum sample was anodized in 0.1 M perfluorophosphonic/perfluorophosphinic acid solution and the resulting coatings examined by Fourier Transform Infrared Spectrometry (FTIR). It will be noted that the functionalized layer (perfluoro) remained constant while the aluminum oxide increased as the anodizing voltage was increased. Thus, it can be seen that the functionalized layer remains on the surface and is not incorporated in the oxide layer.

Figure 4:
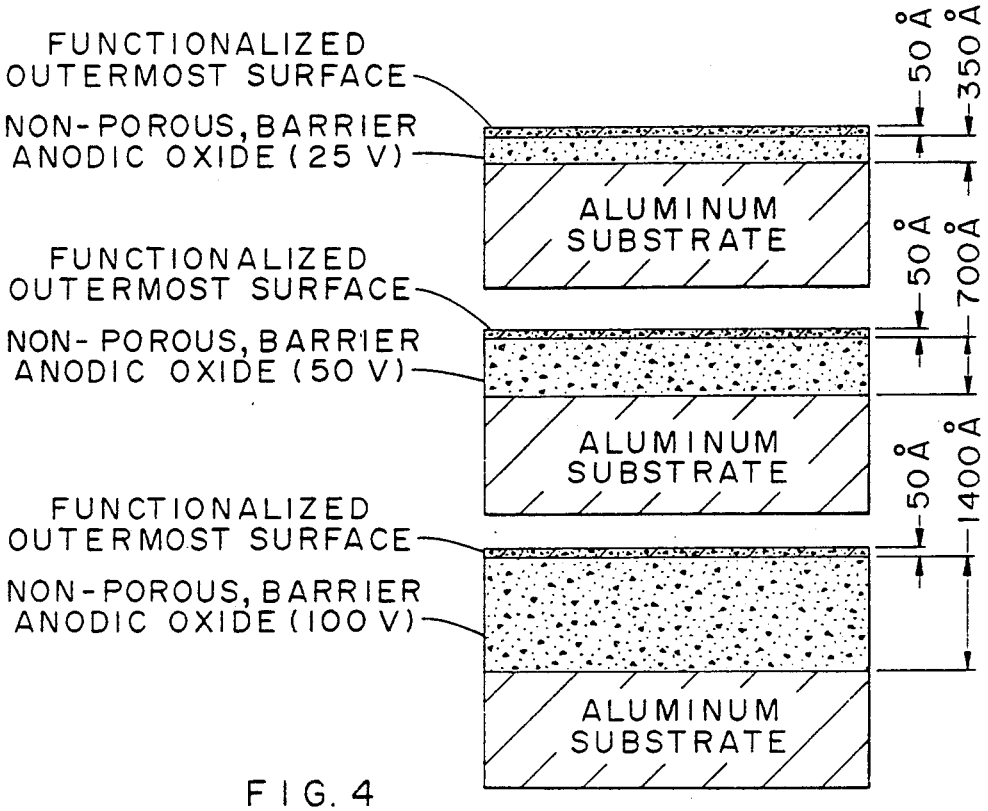
FIG. 4 is a schematic representing the increase in oxide thickness with voltage and the constant thickness of the functionalized layer.

FIG. 4 is illustrative of the increase in aluminum oxide thickness with increase in voltage and further illustrates that the functionalized layer remains about the same thickness with an increase in voltage.

The properties of the functionalized outermost layer may be controlled for specific applications. Properties such as wetting, chemical reactivity, polarity, hydrophobicity, hydrophilicity can affect the performance for the intended application. For example, a functionalized layer can be used for improved adhesive bonding of polymers. Adhesives which may be used for the functionalized layer include hot-melt adhesives such as polyethylene, other polyolefins or mixtures, ethylene-vinyl acetate copolymers, polyamides, polyesters, block copolymer rubbers; solution adhesives (water soluble) such as phenolics, amino resins, poly (vinyl methyl ether), poly (vinyl alcohol), dextrin; solution adhesives (organic solvent soluble) such as natural rubber and other elastomers, acrylics, polyurethanes, polyamides, phenoxies, poly (vinyl acetals), polystyrenes; contact adhesives such as mixtures of chloroprene or nitrile rubber with oil-soluble phenolic, resins; aqueous dispersions such as acrylics, chloroprene, poly (vinyl acetate), polyurethanes, epoxies, silicones; activated adhesives such as poly (vinyl alcohol), rubber, vinyl formal polymers, phenoxies, cellulosics, poly (vinyl chloride); film adhesives such as epoxies, phenolics, nitrile elastomer and blends thereof, polyamides, poly (vinyl butyral) poly (vinyl chloride), ethylene-carboxylic acid copolymers; reactive polymers (thermosets) such as polyimide, polybenzimidazole, epoxies, phenolics, polyurethanes, cyanoacrylates, anaerobic acrylics; reactive polymers (electron beam or ultraviolet light curing) such as urea-formaldeyde, phenolics; pressure sensitive such as tackified elastomers, poly (alkyl acrylates), silicones.

The functionalized layer can provide an excellent surface for adhesion of: paints, primers, architectural paints such as organic solvent thinned paints, shellacs, cellulose derivatives, acrylic resins, vinyl resins, bitumens, and water thinned paints (latexes) such as copolymers of butadiene and styrene,. polyvinyl acetate, acrylic resin; commercial finishes such as air-drying finishes such as epoxies, urethanes, polyester resins, alkyds, modified rubbers, and baking finishes such as acrylic resins, phenolic resins; industrial coatings such as corrosion resistant coatings, phenolic resins, chlorinated rubber, epoxies, epoxies cured from a solvent solution with polyfunctional amines, polyamide resins, vinyl resin, elastomers, polyesters, and polyurethanes, and high temperature coatings such as silicone rubber, silicone resins, polyamides; and immersion service coatings such as epoxy-furans, amine-cured epoxies, flurorocarbons, furfuryl alcohol resins, neoprene, unmodified phenolics, unsaturated polyesters, polyether resins, low-density polyethylene, chlorosulfonated polyethylene, polyvinyl chloride plastisols, resinous cements, rubber, urethanes.

Thus, it will be seen that valve metal surfaces can be modified by the use of the functionalized layer to achieve higher performance in all types of bonding.

Sheet stock produced in accordance with the present invention is suitable for use as end stock for easy open ends particularly when coated with a polymeric material. Such polymeric materials can be applied to the duplex coatings of the invention with resulting superior bond strengths, particularly if such polymeric coatings are bonded using reactive groups on the functionalized layer.

Duplex layers in accordance with the invention were prepared as set forth in the following Examples.

EXAMPLE 1

Two specimens of AA2090 were provided in mill finish and vapor degreased in trichloroethylene for 5 minutes. Thereafter, they were etched in $HF/HNO_3$ etch solution, then anodized in an aqueous solution containing 9 wt. % vinyl phosphonic acid at 40 V at a temperature of 23° C. Anodizing was carried out until the current flow approached zero which was less than one minute. The duplex layer had a thickness of about 560Å as determined by Auger Electron Spectroscopy (AES) and Ion Scattering Spectroscopy (ISS) depth profiling. No porosity was observed in the duplex layer when observed with Transmission Electron Microscopy (TEM).

EXAMPLE 2

This Example was anodized under the same conditions except the acid concentration was 18 wt. % and pH was 0.4. The duplex layer had a thickness of about 560Å as determined by AES depth profiling.

EXAMPLE 3

This Example was the same as Examples 1 and 2. In addition, the treated specimens, when joined with a rubber modified epoxy paste adhesive, exhibited joint strength and hydrothermal durability comparable to aluminum substrates conventionally anodized with phosphoric acid. The joint strength was measured by lap shear test ASTM D1002 and wedge test ASTM D3762-79.

EXAMPLE 4

This Example was the same as Examples 1 and 2 except AA5182 and AA5042 were used as test specimens which were cleaned in an alkaline solution and anodized at 10 and 40 volts for 10 seconds. In addition, these specimens were then coated with a polyvinyl chloride thermosetting polymer and fabricated into cans and can end stock. The performance was equivalent to that of metal receiving a conventional chromate conversion coating in terms of coating adhesion and resistance to corrosion under test conditions simulating processing and storage of filled containers.

EXAMPLE 5

This Example used AA2024 specimens, which were provided in mill finish and vapor degreased in trichloroethylene for 5 minutes. Thereafter, the specimens were etched in chromate/sulfuric acid etch solution, then anodized in an aqueous solution containing 18% vinyl phosphonic acid at 20 V at a temperature of 23° C. Anodizing was carried out until the current flow approached zero which took less than one minute. The duplex layer had a thickness of about 280Å as determined by AES depth profiling.

EXAMPLE 6

In this Example, AA6061 specimens were used and given an $HF/HNO_3$ etch. Specimens were anodized in phenyl phosphonic acid at 1.0 M at a pH of 0.9 at 40 and 60 V for less than one minute. AES depth profiling showed that the duplex coatings formed had thicknesses of about 560Å and 840Å, respectively. No porosity was observed in the duplex layer when observed with TEM.

EXAMPLE 7

This Example was the same as Example 5, but in addition, the treated specimens, when joined with a rubber modified epoxy paste adhesive, exhibited joint strength (per ASTM D-1002) and hydrothermal durability (per ASTM D3762–79) comparable to aluminum substrates treated with conventional chromate conversion coatings.

EXAMPLE 8

This Example was the same as Example 5 except that the specimen was anodized at 40 V for 30 seconds. Sessile drop water contact angle on the specimen was 65°, compared to 14° for etched only AA6061.

EXAMPLE 9

This Example was the same as Example 5 except that the specimen was anodized at 40 V for 30 seconds. The specimen was subjected to an environment of 38° C. and condensing humidity. The specimen was exposed for 42 hours before visible signs of surface hydration were observed, compared to 6 hours for etched only AA6061.

EXAMPLE 10

This Example was the same as Example 5 except 0.09 M styrene phosphonic acid at a pH of 1.7 was used at 20 and 40 V in less than one minute, the current approached zero, indicating the formation of a non-porous, duplex oxide layer.

EXAMPLE 11

This Example was the same as Example 5 except 0.1 M nitrilo (trismethylene) triphosphonic acid (NTMP) was used at a pH of 1.6 and anodized at 20 V. No porosity was observed in the duplex layer when observed with TEM. In addition, the specimen was subjected to an environment of 38° C. and condensing humidity. The specimen was exposed for 42 hours before visible signs of corrosion (hydration) were observed, compared to 7 hours for specimens which were not anodized, but only soaked for one hour in 0.1 M NTMP solution.

EXAMPLE 12

This Example was the same as Example 5 except 0.1 M phenyl phosphinic acid having a pH of 1.6 was used, and the specimens were anodized at 25 and 50 V. The duplex film formed was similar to that formed in Example 5, as determined by FTIR.

EXAMPLE 13

This Example used specimens of AA6061 which were cleaned and etched as in Example 5 and anodized in an aqueous solution containing 43.4 g/L perfluorinated phosphonic/phosphinic acid mixture at 20, 40, 60, 80, 100, 120, 160, 200 and 240 V. FTIR demonstrated that increasing voltage increased the thickness of the aluminum oxide portion of the duplex film but had no effect on the thickness of the organophosphorus portion of the duplex film. Furthermore, sessile water drop contact angles were about 105°, compared to about 14° for etched only AA6061.

EXAMPLE 14

This Example used specimens of AA6061 which were cleaned and etched as in Example 5 and then anodized in 0.1 M allylphosphinic acid at 20, 40, and 60 V and in 1.0 M of the same electrolyte at 40 and 60 V at a pH of 0.9. The samples were anodized until the current approached zero, indicating the formation of a duplex barrier layer.

EXAMPLE 15

This Example used specimens of AA6061 cleaned and etched as in Example 5 which were anodized at 23° C. in 9 wt. % vinyl phosphonic acid at 10, 20, 30, and 40 V and in 18 wt. % vinyl phosphonic acid having a pH of 0.4 at 20 and 40 V, respectively. Anodization took less than one minute, until the current approached zero. Specimens anodized at 40 V had a duplex film thickness of about 560Å, as determined by ISS and AES depth profiling. No porosity was observed in the duplex layer when observed with TEM. Furthermore, specimens anodized at 40 V, when joined with a rubber modified epoxy paste adhesive, exhibited joint strength and hydrothermal durability comparable to aluminum substrates conventionally anodized for 20 minutes in phosphoric acid solution.

EXAMPLE 16

This Example was the same as Example 12 except the specimens were not cleaned and etched but anodized at 40 V. The duplex films formed had a thickness of about 560Å, as determined by AES depth profiling. No porosity was observed in the duplex layer when observed with TEM. Furthermore, specimens anodized at 40 V, when joined with a rubber modified epoxy paste adhesive, exhibited joint strength and hydrothermal durability comparable to aluminum substrates conventionally anodized for 20 minutes in phosphoric acid solution.

EXAMPLE 17

Specimens of AA5182 (containing 4 to 5% Mg, 0.2 to 0.5% Mn, 0.2% max. Si, 0.35% max. Fe, 0.15% max. Cu, 0.1% max. Cr, 0.25% max. Zn, 0.1% max. Ti, the balance substantially aluminum) or AA5352 (containing 2.2 to 2.8% Mg, silicon + iron not exceeding 0.45%, 0.1% max. Cu, 0.1% max. Mn, 0.1% max. Cr, 0.1% max. Zn, 0.1% max. Ti, balance substantially aluminum) alloy were coated with the duplex coating of the invention by anodizing at 10 V in vinyl phosphonic acid at 23° C. for less than 10 seconds and then coated with thermosetting polymeric coatings such as polyvinyl chloride, epoxy, and epoxy modified polyvinyl chloride with a high level of adhesion.

EXAMPLE 18

Specimens of AA3003 alloy, anodized at 10 V in vinylphosphonic acid at 23° C. for less than 10 seconds, were coated with polyvinyl chloride and polyvinyl acetate, to provide a high level of adhesion.

EXAMPLE 19

Specimens of AA1045, AA1100, and AA3003, anodized at 10 V in vinyl phosphonic acid at 23° C. for less than 10 seconds, were laminated to polypropylene and polyester foil using a urethane adhesive with a high level of adhesion.

EXAMPLE 20

Specimens of AA6061 were tested for structural adhesive bonding. Specimens of these alloys were anodized at 40 V in phenyl phosphonic acid at 23° C. for 30 seconds. These specimens were bonded with epoxy paste adhesive and tested by ASTM lap shear test D1002 and ASTM wedge test 3762-79. Performance of the adhesives on these functionalized surfaces reached or exceeded that on these alloys etched or after a chromate conversion coating was applied.

In addition, these alloys were found to have superior hydration resistance in condensing humidity tests when compared to chromate conversion coatings on the same alloys. Acids tested on these alloys were nitrilo trismethylene triphosphonic acid, phenyl phosphonic acid, and vinyl phosphonic acid. The hydrophobicity of the surface can be improved by use of the present invention. For example, when perfluorinated phosphonic acid was applied to specimens of 6061 alloy, it increased the contact angle of water from 14° to greater than 105°.

Thus, coatings in accordance with the invention can be applied to AA5000 series, aluminum alloys (alloys containing a major amount of Mg, for instance alloys containing 0.5 to 5.5% Mg, with or without up to 1.2% Mn) e.g., AA5182 or AA5352 useful for container ends. Also, it may be applied to AA3000 aluminum alloys (alloys containing a major amount of Mn, for instance, an alloy containing 0.2 to 1.8% Mn, with or without up to 1.3% Mg) series, e.g., useful for formed containers such as food and beverage containers. For convenience, alloy series 5XXX and 3XXX can be generically grouped as aluminum alloys containing magnesium or manganese, or both, and alloy series 1XXX can be viewed as essentially unalloyed aluminum or at least 99% aluminum. Foils fabricated from AA1000 series, e.g., AA1045 or AA1100, may be coated in accordance with the invention.

Thus, the invention provides a process for forming a protective coating on a valve metal surface comprising a first layer of a valve metal oxide and a layer of monomeric phosphonic/phosphinic acid chemically bound to the valve metal oxide layer.

Having thus described the invention, what is claimed is:

1. A layered material comprised of:
(a) a base layer of a valve metal selected from the class consisting of aluminum, niobium, tantalum, titanium, or zirconium, alloys of two of more of such metals, and alloys of one or more of such metals together with one or more alloying metals selected from the class consisting of silicon, iron, copper, manganese, molybdenum, chromium, nickel, zinc, vanadium, titanium, boron, lithium and zirconium; and
(b) a duplex layer comprised of:
(i) an intermediate layer consisting essentially of a non-porous barrier layer type valve metal oxide attached to said base layer; and
(ii) an acid resistant, functionalized layer of a monomeric phosphorus-containing compound chemically bonded to a surface of said oxide layer, the functionalized layer comprised of the reaction product of an acid selected from phosphonic and phosphinic acid and the valve metal oxide.

2. The layered material in accordance with claim 1 wherein the phosphonic acid is a monomeric phosphonic acid having the formula $R_m[PO(OH)_2]_n$ wherein R is one or more radicals having a total of 1-30 carbons; m is the number of radicals in the molecule and is in the range of 1-10; n is the number of phosphonic acid groups in the molecule and is in the range of 1-10.

3. The layered material in accordance with claim 2 wherein the phosphinic acid is a monomeric phosphinic acid having the formula $R_mR'_o[PO(OH)]_n$ wherein R is one or more radicals having a total of 1-30 carbons; m is the number of R radicals in the molecule and is in the range of 1-10; R' may be hydrogen and may be comprised of 1-30 carbon-containing radicals; o is the number of R' radicals and is in the range of 1-10; n is the number of phosphinic acid groups in the molecule and is in the range of 1-10.

4. The layered material in accordance with claim 2 wherein R is in the range of 2-12.

5. The layered material in accordance with claim 3 wherein R is in the range of 2-12.

6. The layered material in accordance with claim 1 wherein the functionalized layer has a thickness of less than 200Å.

7. The layered material in accordance with claim 1 wherein the functionalized layer has a thickness of less than 100Å.

8. The layered material in accordance with claim 1 wherein the valve metal oxide has a phosphorus to valve metal ratio of 0.001 to 0.5.

9. A layered material comprised of:
(a) a base layer of aluminum alloy; and
(b) a duplex layer comprised of:
(i) an intermediate layer consisting essentially of a non-porous barrier layer type aluminum oxide attached to said base layer; and
(ii) an acid resistant, functionalized layer of an organic monomeric phosphorus-containing compound chemically bonded to a surface of said oxide layer.

10. The layered material in accordance with claim 1 wherein said duplex layer has an atomic weight ratio of phosphorus to aluminum of 0.001 to 0.5.

11. The layered material in accordance with claim 9 wherein said aluminum oxide layer is at least 90 wt. % aluminum oxide.

12. The layered material in accordance with claim 9 wherein said aluminum oxide layer is at least 95 wt. % aluminum oxide.

13. The layered material in accordance with claim 1 wherein said aluminum oxide layer is at least 98 wt. % aluminum oxide.

14. The layered material in accordance with claim 1 wherein said oxide layer results from anodization of said base layer.

15. The layered material in accordance with claim 1 wherein said oxide layer has a density of 2.8 to 3.2 gms/cc.

16. The layered material in accordance with claim 1 wherein said oxide layer has a thickness of 100 to 5000Å.

17. The layered material in accordance with claim 1 wherein said oxide layer has a thickness of 400 to 1000Å.

18. The layered material in accordance with claim 1 wherein said functionalized layer has a thickness of less than 200Å.

19. The layered material in accordance with claim 1 wherein said functionalized layer has a thickness of less than 100Å.

20. The layered material in accordance with claim 1 wherein said functionalized layer has a thickness of less than 30Å.

21. The layered material in accordance with claim 14 wherein said anodization is carried out in a water containing solution having a monomeric phosphorus-containing acid selected from phosphinic and phosphonic acids and mixtures thereof.

22. The layered material in accordance with claim 14 wherein said acid resistant functionalized layer protects said oxide layer from dissolution during said anodization.

23. The layered material in accordance with claim 1 wherein said duplex layer has an atomic weight ratio of phosphorus to aluminum of 0.02 to 0.2.

24. The layered material in accordance with claim 14 wherein said oxide layer is produced at a weight gain of less than 0.9 mg/coulomb.

25. The layered material in accordance with claim 14 wherein said oxide layer is in the range of 0.08 to 0.1 mg/coulomb.

26. The layered material in accordance with claim 14 wherein the functionalized layer is comprised of the reaction product of an acid selected from monomeric phosphonic and phosphinic acid with aluminum oxide.

27. The layered material in accordance with claim 26 wherein the functionalized layer is comprised of the reaction product of phosphonic acid and aluminum oxide and the phosphonic acid has the formula $R_m[PO(OH)_2]_n$ wherein R is one or more radicals having a total of 1-30 carbons; m is the number of radicals in the molecule and is in the range of 1-10; n is the number of phosphonic acid groups in the molecule and is in the range of 1-10.

28. The layered material in accordance with claim 26 wherein the functionalized layer is comprised of the reaction product of phosphinic acid and aluminum oxide and the phosphinic acid has the formula $R_mR'_o[PO(OH)]_n$ wherein R is one or more radicals having a total of 1-30 carbons; m is the number of R radicals in the molecule and is in the range of 1-10; R' may be hydrogen and may be comprised of 1-30 carbon-containing radicals; o is the number of R' radicals and is in the range of 1-10; n is the number of phosphinic acid groups in the molecule and is in the range of 1-10.

29. The layered material in accordance with claim 1 wherein the aluminum alloy contains magnesium or manganese, or both.

30. The layered material in accordance with claim 29 wherein the aluminum alloy is selected from an aluminum alloy containing 4 to 5% Mg, 0.2 to 0.5% Mn, 0.2% max. Si, 0.35% max. Fe, 0.15% max. Cu, 0.1% max. Cr, 0.25% max. Zn, 0.1% max. Ti, the balance substantially aluminum and an alloy containing 2.2 to 2.8% Mg, silicon + iron not exceeding 0.45%, 0.1% max. Cu, 0.1% max. Mn, 0.1% max. Cr, 0.1% max. Zn, 0.1% max. Ti, balance substantially aluminum.

31. A layered material comprised of:

(a) a base layer of aluminum or aluminum alloy; and (b) a duplex layer comprised of:

(i) an intermediate layer consisting essentially of a non-porous barrier layer type aluminum oxide attached to said base layer having a density of 2.8 to 3.2 gms/cc, being greater than 95 wt. % aluminum oxide, having a thickness in the range of 100 to 5000Å and resulting from the anodization of said base layer in a monomeric phosphorus-containing acid selected from phosphonic and phosphinic acid produced at 12 to 16Å and at a weight gain of 0.03 to 0.2 mg/coulomb; and (ii) an acid resistant, functionalized layer of an organic monomeric phosphorus-containing compound chemically bonded to a surface of said oxide layer, the duplex layer having an atomic weight ratio of phosphorus to aluminum in the range of 0.001 to 0.5.

32. The layered material in accordance with claim 31 wherein the base layer is a flat rolled product.

33. The layered material in accordance with claim 32 wherein the flat rolled product is a sheet or foil product.

34. The layered material in accordance with claim 31 wherein the alloy is selected from substantially aluminum or an aluminum alloy containing magnesium or manganese, or both.

35. The layered material in accordance with claim 34 wherein the base layer is foil stock fabricated from aluminum or an aluminum alloy containing manganese.

36. The layered material in accordance with claim 34 wherein the base layer is sheet stock fabricated from an aluminum alloy selected from an alloy containing 4 to 5% Mg, 0.2 to 0.5% Mn, 0.2% max. Si, 0.35% max. Fe, 0.15% max. Cu, 0.1% max, Cr, 0.25% max. Zn, 0.1% max. Ti, the balance substantially aluminum, and an alloy containing 2.2 to 2.8% Mg, silicon + iron not exceeding 0.45%, 0.1% max. Cu, 0.1% max. Mn, 0.1% max. Cr, 0.1% max. Zn, 0.1% max. Ti, balance substantially aluminum.

37. Coated aluminum stock, the coating comprised of:

(a) a layer of non-porous aluminum oxide bonded to a surface of said stock; and (b) a functionalized layer of an organic monomeric phosphorus-containing compound chemically bonded to a surface of said oxide layer.

38. The coated aluminum stock in accordance with claim 37 wherein said oxide and the functionalized layer have an atomic weight ratio of phosphorus to aluminum of 0.001 to 0.5.

39. The coated aluminum stock in accordance with claim 37 wherein said aluminum oxide layer is at least 98 wt. % aluminum oxide.

40. The coated aluminum stock in accordance with claim 37 wherein said oxide layer results from anodization of said base layer.

41. The coated aluminum stock in accordance with claim 37 wherein said oxide layer has a thickness of 100 to 5000 Å.

42. The coated aluminum stock in accordance with claim 37 wherein said oxide layer has a thickness of 200 to 1000 Å.

43. The coated aluminum stock in accordance with claim "wherein said functionalized layer has a thickness of less than 200Å.

44. The coated aluminum stock in accordance with claim 37 wherein said functionalized layer has a thickness of less than 100Å.

45. The coated aluminum stock in accordance with claim 37 wherein said functionalized layer has a thickness of less than 30Å.

46. The coated aluminum stock in accordance with claim 37 wherein said oxide and the functionalized layer have an atomic weight ratio of phosphorus to aluminum of 0.02 to 0.2.

47. The coated aluminum stock in accordance with claim 40 wherein said oxide layer is produced in a range of 13.8 to 14.2 Å/V.

48. The coated aluminum stock in accordance with claim 40 wherein the functionalized layer is comprised of the reaction product of an acid selected from monomeric phosphonic and phosphinic acid with aluminum oxide.

49. The coated aluminum stock in accordance with claim 37 wherein the aluminum substrate is sheet stock fabricated from an aluminum alloy containing magnesium or manganese, or both.

50. The coated aluminum stock in accordance with claim 49 wherein the sheet stock is selected from an alloy containing 4 to 5% Mg, 0.2 to 0.5% Mn, 0.2% max. Si, 0.35% max. Fe, 0.15% max. Cu, 0.1% max. Cr, 0.25% max. Zn, 0.1% max. Ti, the balance substantially aluminum, and an alloy containing 2.2 to 2.8% Mg, silicon + iron not exceeding 0.45%, 0.1% max. Cu, max. Cu, 0.1% max. Mn, 0.1% max. Cr, 0.1% max. Zn, 0.1% max. Ti, balance substantially aluminum and formed into ends for beverage containers.

51. A coated aluminum sheet and foil stock suitable for food and beverage container ends, the coating on said stock comprised of a layer of a non-porous aluminum oxide thereon, said porous layer having chemically bonded to a surface thereof, a functionalized layer of an organic monomeric phosphorus-containing compound.

52. The coated aluminum stock in accordance with claim 51 wherein said coating has an atomic weight ratio of phosphorus to aluminum of 0.001 to 0.5.

53. The coated aluminum stock in accordance with claim 51 wherein said aluminum oxide layer is at least 90 wt. % aluminum oxide.

54. The coated aluminum stock in accordance with claim 51 wherein said aluminum oxide layer is at least 95 wt. % aluminum oxide.

55. The coated aluminum stock in accordance with claim 51 wherein said oxide layer results from anodization of said sheet or foil stock.

56. The coated aluminum stock in accordance with claim 51 wherein said oxide layer has a density of 2.8 to 3.2 gms/cc.

57. The coated aluminum stock in accordance with claim 51 wherein said oxide layer has a thickness of 100 to 5000Å.

58. The coated aluminum stock in accordance with claim 51 wherein said oxide layer has a thickness of 400 to 1000Å.

59. The coated aluminum stock in accordance with claim 51 wherein said functionalized layer has a thickness of less than 200Å.

60. The coated aluminum stock in accordance with claim 51 wherein said functionalized layer has a thickness of less than 100Å.

61. The coated aluminum stock in accordance with claim 51 wherein said functionalized layer has a thickness of less than 30Å.

62. The coated aluminum stock in accordance with claim 55 wherein said anodization is carried out in a water containing solution having a monomeric phosphorus-containing acid selected from phosphinic and phosphonic acids and mixtures thereof.

63. The coated aluminum stock in accordance with claim 55 wherein said acid resistant functionalized layer which protects said oxide layer from dissolution during said anodization.

64. The coated aluminum stock in accordance with claim 51 wherein said coating has an atomic weight ratio of phosphorus to aluminum of 0.02 to 0.2.

65. The coated aluminum stock in accordance with claim 55 wherein said oxide layer is produced at less than 25 Å/V.

66. The coated aluminum stock in accordance with claim 55 wherein said oxide layer is produced in a range of 12 to 16 Å/V.

67. The coated aluminum stock in accordance with claim 55 wherein said oxide layer is produced in a range of 13.8 to 14.2 Å/V.

68. The coated aluminum stock in accordance with claim 55 wherein said oxide layer is produced at a weight gain of less than 0.9 mg/coulomb.

69. The coated aluminum stock in accordance with claim 55 wherein said oxide layer is less than 0.9 mg/coulomb.

70. The coated aluminum stock in accordance with claim 55 wherein said oxide layer is in the range of 0.03 to 0.2 mg/coulomb.

71. The coated aluminum stock in accordance with claim 55 wherein said oxide layer is in the range of 0.08 to 0.1. mg/coulomb.

72. The coated aluminum stock in accordance with claim 55 wherein the functionalized layer is comprised of the reaction product of an acid selected from monomeric phosphonic and phosphinic acid with aluminum oxide.

73. The coated aluminum stock in accordance with claim 72 wherein the functionalized layer is comprised of the reaction product of phosphonic acid and aluminum oxide and the phosphonic acid has the formula $RPO(OH)_2$ where R is a 2–30 carbon-containing monomeric radical.

74. The coated aluminum stock in accordance with claim 72 wherein the functionalized layer is comprised of the reaction product of phosphinic acid and aluminum oxide and the phosphinic acid has the formula $RR'PO(OH)$ where R' may be hydrogen and both R and R' may each be comprised of 2–30 carbon-containing monomeric radicals.

75. The coated aluminum stock in accordance with claim 51 wherein the aluminum substrate is sheet stock fabricated from an aluminum alloy containing magnesium or manganese, or both.

76. The coated aluminum stock in accordance with claim 51 wherein the sheet stock is selected from an alloy containing 4 to 5% Mg, 0.2 to 0.5% Mn, 0.2% max. Si, 0.35% max. Fe, 0.15% max. Cu, 0.1% max. Cr, 0.25% max. Zn, 0.1% max. Ti, the balance substantially aluminum, and an alloy containing 2.2 to 2.8% Mg, silicon + iron not exceeding 0.45%, 0.1% max. Cu, max. Cu, 0.1% max. Mn, 0.1% max. Cr, 0.1% max. Zn, 0.1% max. Ti, balance substantially aluminum and formed into ends for beverage containers.

77. Coated aluminum stock, the coating comprised of:

(a) a layer of non-porous aluminum oxide bonded to a surface of said stock, the oxide layer having a density of 2.8 to 3.2 gms/cc, a thickness in the range of 100 to 5000Å, being greater than 95 wt. % aluminum oxide, the oxide layer resulting from anodization in a monomeric phosphorus-containing acid selected from phosphonic and phosphinic acid produced at 12 to 16Å/V and at a weight gain of 0.03 to 0.2 mg/coulomb; and (b) a functionalized layer of an organic monomeric phosphorus-containing compound chemically bonded to a surface of said oxide layer, the oxide layer and the functionalized layer having a ratio of phosphorus to aluminum in the range of 0.01 to 0.5.

78. The coated stock in accordance with claim 77 wherein the aluminum stock is selected from essentially, aluminum and an aluminum alloy containing magnesium or manganese, or both.

79. The coated stock in accordance with claim 78 wherein sheet stock fabricated from an aluminum alloy selected from an alloy containing 4 to 5% Mg, 0.2 to 0.5% M, 0.2% max. Si, 0.35% max. Fe, 0.15% max. Cu, 0.1% max. Cr, 0.25% max. Zn, 0.1% max. Ti, the balance substantially aluminum, and an alloy containing 2.2 to 2.8% Mg, silicon + iron not exceeding 0.45%, 0.1% max. Cu, 0.1% max. Mn, 0.1% max. Cr. 0.1% max. Zn, 0.1% max. Ti, balance substantially aluminum.

* * * * *